US005654519A

United States Patent [19]

Albrecht et al.

[11] Patent Number: 5,654,519

[45] Date of Patent: Aug. 5, 1997

[54] AUTOMATIC PISTOL

[75] Inventors: Hermann Albrecht; Helmut Weldle, both of Oberndorf; Hans-Peter Bantle, Dunningen, all of Germany

[73] Assignee: Heckler & Koch GmbH, Oberndorf/Neckar, Germany

[21] Appl. No.: 419,807

[22] Filed: Apr. 11, 1995

[30] Foreign Application Priority Data

Dec. 9, 1994 [DE] Germany ..... 44 43 940.7

[51] Int. Cl.[6] ..... F41A 21/36

[52] U.S. Cl. ..... 89/163; 89/196

[58] Field of Search ..... 89/163, 196, 14.2, 89/14.3, 14.4; 42/75.02

[56] References Cited

U.S. PATENT DOCUMENTS

| | | | |
|---|---|---|---|
| 1,348,284 | 8/1920 | Loomis | 89/196 |
| 1,738,751 | 12/1929 | Bluehdorn | 89/14.4 |
| 2,448,382 | 8/1948 | Mason | 89/14.4 |
| 2,489,816 | 11/1949 | Reilly | 89/163 |
| 2,898,693 | 8/1959 | Ruger | 42/77 |
| 3,158,064 | 11/1964 | Charron | 89/196 |
| 3,411,406 | 11/1968 | Pachmayr et al. | 89/196 |
| 3,411,408 | 11/1968 | Pachmayr et al. | 89/196 |
| 3,504,594 | 4/1970 | Greeley . | |
| 3,564,967 | 2/1971 | La Violette | 89/163 |
| 3,975,982 | 8/1976 | Terstegge | 89/163 |
| 4,031,808 | 6/1977 | Raville | 89/163 |
| 4,173,169 | 11/1979 | Yates et al. | 89/132 |
| 4,178,833 | 12/1979 | Miller | 89/163 |
| 4,479,481 | 10/1984 | Beretta | 89/14.4 |
| 4,501,189 | 2/1985 | Brandl et al. | 89/14.4 |
| 4,510,843 | 4/1985 | Rabatin | 89/14.4 |
| 4,896,581 | 1/1990 | Cole . | |
| 5,415,073 | 5/1995 | Ciluffo | 89/14.3 |

FOREIGN PATENT DOCUMENTS

| | | |
|---|---|---|
| 2158885 | 6/1973 | France . |
| 187246 | 3/1906 | Germany . |
| 226588 | 4/1909 | Germany . |
| 334042 | 3/1921 | Germany . |
| 347573 | 1/1922 | Germany . |
| 2251861 | 10/1972 | Germany . |
| 20277 | of 1910 | United Kingdom . |

OTHER PUBLICATIONS

Mechanical Engineering Reference Manual; Michael R. Lindeburg; Professional Publications; pp.14–2,3 1990.

*Primary Examiner*—Michael J. Carone
*Assistant Examiner*—Christopher K. Montgomery
*Attorney, Agent, or Firm*—Darby & Darby

[57] ABSTRACT

An automatic pistol, with at least a barrel (1) and a slide (2) that move relative to the rest of the firearm and to each other, whereby the barrel extends through an alignment channel (3) in the slide. The weapon included means (4) of centering the barrel around at least one axis through the slide such that the barrel will not jam. The means are elastic and resilient and rest lightly against the inner surface of the channel before the weapon is discharged.

5 Claims, 3 Drawing Sheets

AUTOMATIC PISTOL

BACKGROUND OF THE INVENTION

1. Field of the Invention

The present invention relates to a firearm, especially an automatic pistol, with at least a barrel and a slide which move relative to the rest of the firearm and to each other. The barrel extends through an alignment channel in the slide.

2. Description of the Related Art

The Colt-Browning is one example of such a system. Discharge of the weapon is followed by relative motions on the part of various subassemblies. The barrel and slide in particular carry out a joint longitudinal motion. The barrel also tilts relative to the slide. To allow these motions and especially the tilt of the barrel requires considerable play between the outer surface of the barrel and the inner surface of the alignment channel. The same degree of play is needed to accommodate heat expansion on the part of the barrel. The expansion of the barrel is more extensive when the weapon is discharged cold than the expansion of the alignment channel is when the channel is allowed to gradually warm up to the temperature of the barrel. It is, however, essential to ensure that the barrel can tilt in the channel in spite of the heat expansion. The play is also necessary, finally, to prevent contaminants from jamming the weapon.

The weapon's accuracy is of course considerably decreased by the play. More precisely, the scatter pattern of impacts on a particular target is enlarged. This enlargement is even more evident for the first shot subsequent to rechambering, at least when the cartridges are chambered both manually and automatically. How the weapon closes depends on how rapidly the chambering occurs. The first shot is usually too low.

These drawbacks have allegedly been eliminated in a US military pistol specially modified for sports purposes (Model 1911 A1). The barrel-alignment channel is wider, and a new type of barrel is employed, with a barrel-centering protuberance around its outer surface. The protuberance is inside the channel and rests relatively snug against its inner surface before the weapon is discharged. The diameter of the protuberance must precisely equal that of the channel. It is accordingly impossible to replace the barrel rapidly and easily, given the conventional outside-diameter tolerances. The expansion of the barrel and hence of the protuberance that occurs when the weapon is discharged also makes it necessary to prevent jamming by lubricating the weapon and to avoid firing highly charged cartridges. Still another unsolved problem that occurs in conjunction with this embodiment, finally, is connected with contamination. Even low levels will cause the protuberance to wear down rapidly. The aforesaid approach has accordingly almost never been employed until now for military purposes, by ordnance for example. It is and always has been on the other hand particularly for military purposes that firing precision is most necessary. Although the problem has been recognized for more than 80 years, no solution has as yet been discovered.

SUMMARY OF THE INVENTION

The object of the present invention is accordingly to make a weapon of the aforesaid genus more precise without having to accept the aforesaid drawbacks.

This object is attained in a weapon comprising a barrel and a slide which move relative to the rest of the firearm and to each other, whereby the barrel extends through an alignment channel in the slide, and whereby means of centering the barrel around at least one axis through the slide are employed such that the barrel will not jam.

At least some of the barrel-centering means in one preferred embodiment are elastic and resilient.

This feature constitutes a simple approach to preventing the barrel from jamming. It will be unnecessary to carefully adjust the barrel-centering means, a protuberance for example, to fit the barrel. It will be possible to supply the troops with replacement barrels of differing provenance. Contamination, sand for example, will not grind against the centering means, the protuberance for example. The contamination can be removed directly, which will considerably reduce wear.

The barrel-centering means can preferably be elastic and resilient due to their material or shape or both. At least some of the barrel-centering means in one particularly preferred embodiment of the invention can in fact be made of an elastic and resilient rubber or plastic or both. The rubber or plastic or both can preferably be self-lubricating.

Such approaches particularly facilitate and simplify manufacture of the weapon in accordance with the present invention. They also make it possible to replace damaged barrel-centering means without having to replace the barrel or slide. This results in considerable economy. The barrel and slide can be used for their normal life.

The use of an appropriate plastic sufficiently increases resistance to heat and to the oils and other agents employed to clean, maintain, and preserve the metal parts of weapons. Such a plastic will remain resilient longer and resist wear much better than spring steel.

Still another advantage of plastic barrel-centering means is that they are so simple to manufacture in complex shapes. They can for example include cavities or surface structures to accommodate contaminants squeegeed off by the resilient means.

Self lubrication is of particular advantage for weapons that are expected to function smoothly even with extraordinarily low-charge ammunition. This is necessary for example with subsonic munition in indoor firing ranges or with sound insulation.

At least some of the barrel-centering means in another preferred embodiment of the present invention can be made of the same material as or of a material similar to that of the barrel or slide or both. It will in this event be preferable for at least one elastic and resilient barrel-centering means to be a protuberance in the form of a helical spring fastened end to end. At least some barrel-centering means in another preferred embodiment are integrated into the barrel or into the slide.

Further, a firearm is disclosed, wherein at least some of the barrel-centering means are elastic and resilient due to their material or shape or both. This means that elasticity and flexibility can be obtained by the shape of the barrel-centering means. It is for example possible to render a conventional barrel-centering protuberance radially more extensive than usual and to machine a recess in the rear, leaving it thin as sheet metal and bent. It can be provided with radial incisions, leaving resilient tabs resting against the inner surface of the barrel-alignment channel. Barrel-centering means comprising a helical spring fastened end to end are particularly practical. The spring can be made of the same steel as or of a steel similar to the steel the barrel is made of. The spring can also be made of a metal, brass for instance, with low friction relative to the steel it rests against or resistant to corrosion.

The common advantage of all these embodiments is that they can be warehoused without worrying about the barrel-centering protuberance being of a material that might suffer from metal preservatives. Similar resistance to aging is ensured for all components of the weapon. Such a barrel-centering protuberance will also be less sensitive to high temperatures.

At least some of the barrel-centering means in another preferred embodiment expand when heated to the same extent than the barrel or slide or both expand radially or at least not much more. The advantage is that all components will expand uniformly. The original tension will accordingly remain constant or will constantly be returned to.

It is preferable for at least one of the barrel-centering means to essentially comprise a ring. It is especially preferable in this event for the ring to be accommodated in an annular groove extending around the barrel or in the inner surface or front of the slide.

The advantage is that elastic and resilient annular barrel-centering protuberances in the form of rings are particularly simple to replace. A worn protuberance can for example be removed from the groove simply by applying pressure or tension and then stripped off over the barrel. It is on the other hand also possible to destroy or cut it up inside the groove. A new centering protuberance can then be stretched and tensioned into place. When the right kind of plastic is employed, it is also possible to alternatively or additionally shrink the protuberance into the groove in order to ensure that it remains in place and not drop out of the groove while the weapon is being used. Plastics that shrink when heated can be employed for this purpose. It will in this event be possible to easily slide the ring over the barrel and into the groove and heat it with a hotplate or other heating device. This approach particularly facilitates providing troops with spare parts. A plastic ring could for example be included with every thousand shells. At least one spare ring could also be mounted on the weapon itself, in a recess in the bottom of the clip for example or in the side of the stock facing the grip of a hand-held weapon.

At least some of the barrel-alignment channel in one preferred embodiment is essentially cylindrical and at least some of the barrel-centering means constitute a protuberance. At least one barrel-centering protuberance will in this event be accommodated in the barrel-alignment channel before the weapon is discharged. It will in this event be preferable for the centering protuberance to rest subject to slight tension against the inner surface of the barrel-alignment channel or the outer surface of the barrel.

This approach is particularly of advantage in a elastic and resilient barrel-centering protuberance in that there will be no play before the weapon is first discharged. At that time the weapon will be cold, or uniformly warm. Since the barrel and slide will accordingly be expanded to the same extent, this is when play is most extensive in known weapons. This is because the barrel in known weapons of this type initially heats up and accordingly expands more extensively and rapidly than the slide, and the weapon must be dimensioned to take the difference into account. A barrel that is accommodated without play can accordingly function with its total theoretical precision. Whether the protuberance is on the barrel or in the channel is not in principle significant. Positioning the protuberance on the barrel can be of advantage only when the barrel is expected to tilt in relation to the slide. Once this section of the barrel has left the alignment channel, there will be enough play available for the tilting. It is on the other hand also possible to make the protuberance in a design and material that renders play unnecessary.

Such a barrel-centering protuberance can also act like a squeegee. While the weapon is being discharged, that is, the protuberance will wipe the barrel and barrel-alignment channel clean of any dirt, sand, or similar contamination that comes into contact with them before or while the weapon is being discharged. Problems deriving from such contamination as might occur while the weapon's user is traveling over sandy or muddy terrain will accordingly be eliminated.

The barrel will also be uniformly decelerated by the force of the elastic and resilient barrel-centering protuberance as the weapon closes, meaning as the protuberance reenters the barrel-alignment channel. The advantage is that the weapon can be discharged with less effort and that the other components will also be exposed to less wear than previously.

At least part of the barrel-alignment channel or an elevation thereon or both and at least part of the barrel or an elevation thereon or both in another preferred embodiment of the invention have conical or spherical surfaces that fit together. These components will accordingly center themselves automatically.

The advantage of this embodiment is that the necessary play can be minimized from the very beginning. If for example the barrel initially expands farther in diameter than the alignment channel when the weapon is initially discharged, the motion of the slide will only be braked earlier than when the weapon is cold even when the barrel-centering means are rigid. The angle of the cone or curvature of the conical or convex surface of the barrel will on the other hand be maintained. Centering without jamming will accordingly be ensured even when the barrel and slide expand non-uniformly and when the barrel-centering means are rigid. When the aforesaid resilient centering means are also exploited, the combination of barrel and slide will be almost entirely free of play and insensitive to heat and contamination.

The barrel-alignment channel in another preferred embodiment of the invention can be of any desired shape. Some of the barrel-centering means are located on a section of the barrel that projects out of the channel at least before the weapon is discharged. These external barrel-centering means and an external section of the slide or elevation thereon apply force to and center each other at least before the weapon is discharged. It is in this event of advantage for the external barrel-centering means to include both elastic and resilient components and rigid components. The rigid components are employed to mount the external barrel-centering means on the barrel. The rigid components can for example be screwed onto the barrel. It will also be of advantage for the surface of the external barrel-centering means and the surface of the external section of the slide or elevation thereon that come into contact to match.

The simple but effective embodiments hereintofore described facilitate refitting existing firearms just by adapting or replacing the barrel. Most of the advanced versions of the embodiments hereintofore described can simultaneously be exploited, and the aforesaid advantages will be extensively achieved.

The surface of the barrel-centering means (protuberance, specifically ring, torus, section of cone etc.) hereintofore described can be structured, burled for example. Embodiments of the present invention will now be specified by way of example with reference to the accompanying drawing.

DETAILED DESCRIPTION OF THE PREFERRED EMBODIMENTS

Figure 1:
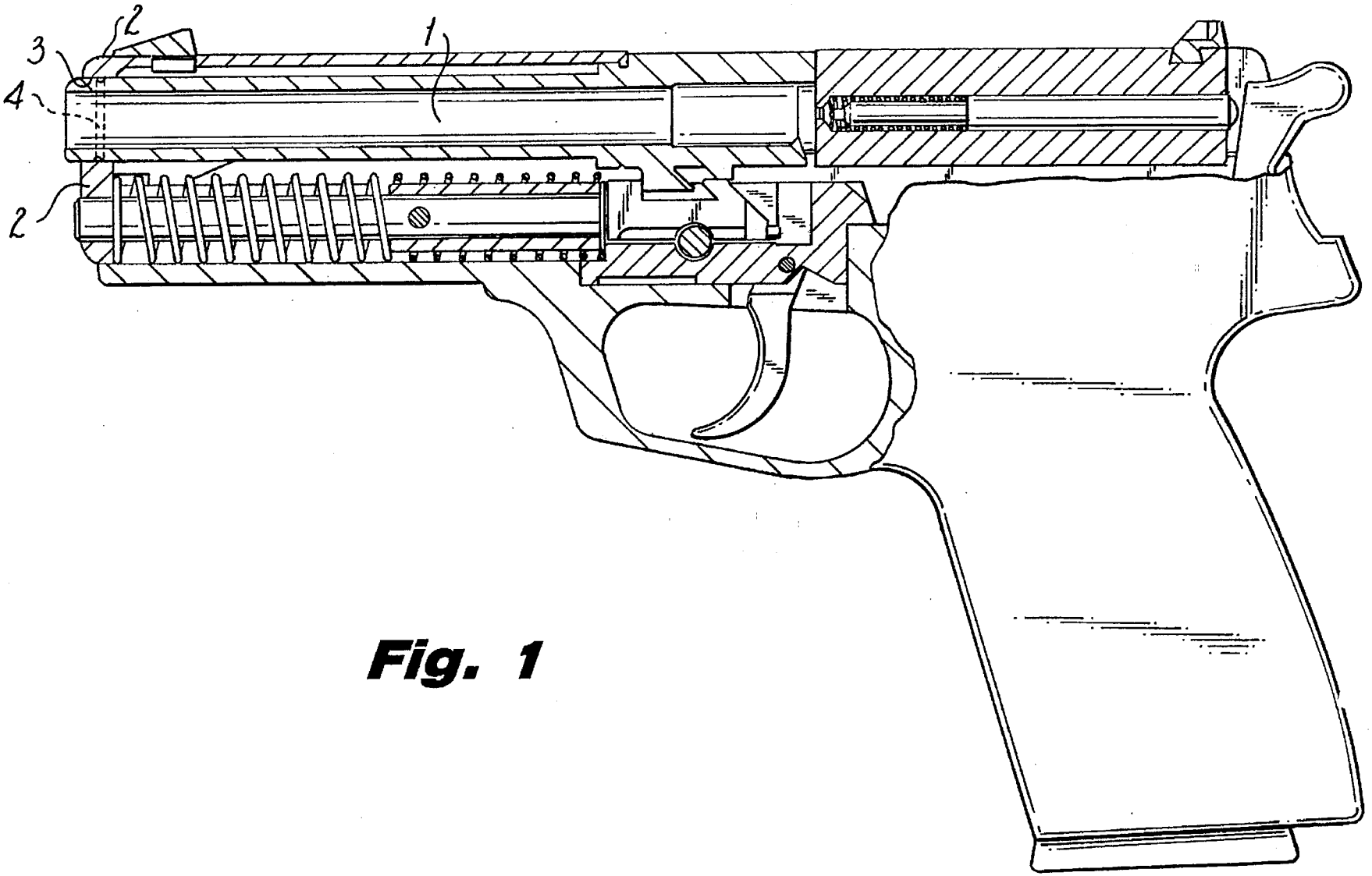
FIG. 1 is a cross-section through one embodiment.

FIG. 1 is a schematic drawing of a locked automatic pistol of the Colt-Browning type. The muzzle of a barrel 1 extends through a barrel-alignment channel 3 in a slide 2. Enough play is left to allow slide 2 and channel 3 to travel backward unimpeded once the weapon is discharged even when the rear end of barrel 1 tilts slightly down out of its illustrated position once the pistol has unlocked. The play, which will be evident from FIG. 2, decreases once the weapon is discharged and barrel 1 heats up and expands while slide 2 remains cool, meaning that the inside diameter of channel 3 remains constant.

Figure 2:
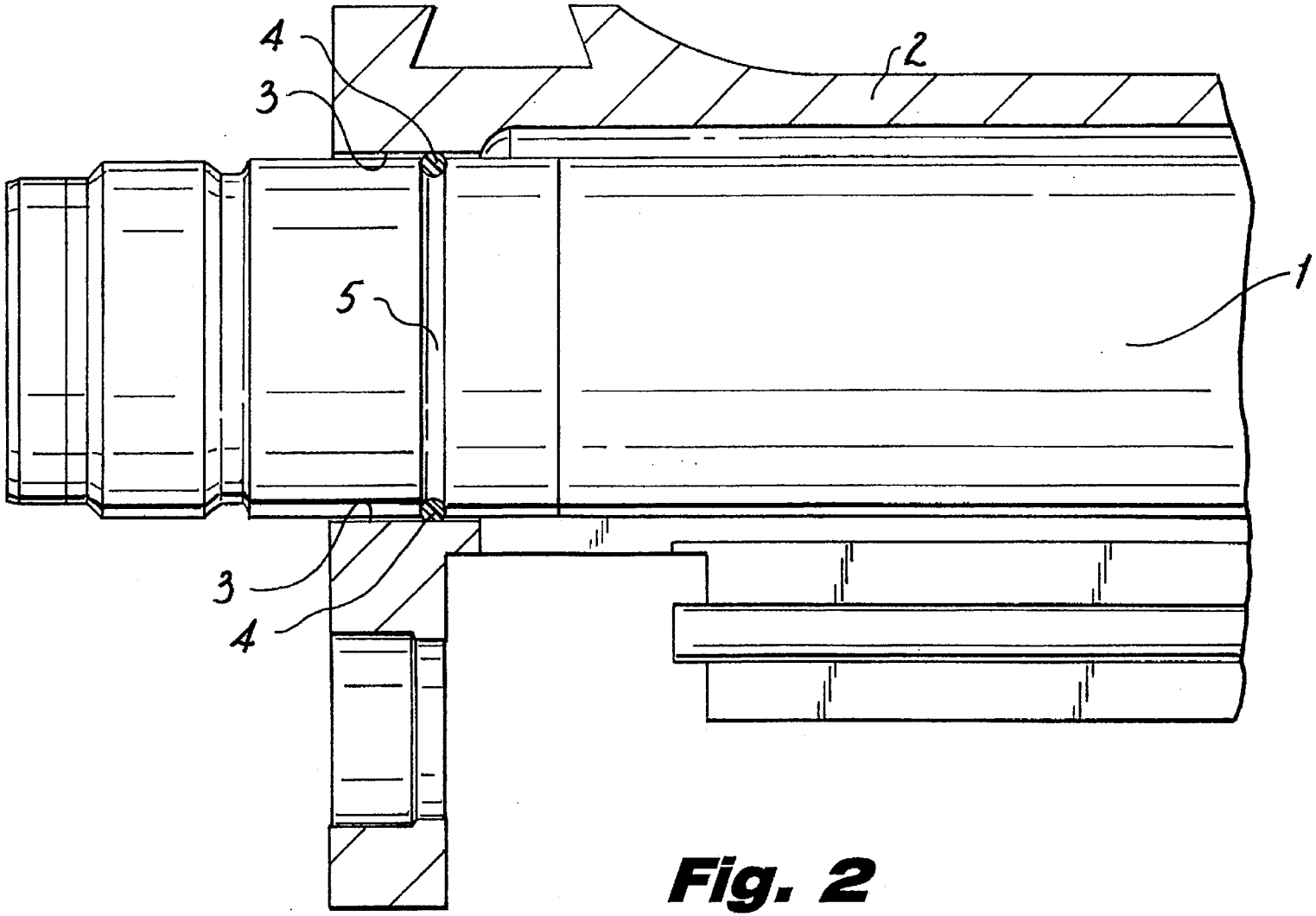
FIG. 2 is a larger-scale detail of FIG. 1 with less important parts left out.

As will be evident from FIG. 2, a barrel-centering protuberance in the form of a torus 4 is accommodated in a groove 5 around barrel 1 in the vicinity of the play. Torus 4 is made of an elastic and resilient material, plastic for example. While the weapon is in the state illustrated in FIG. 1, torus 4 is lightly tensioned against the inner surface of channel 3.

Plastic torus 4 maintains barrel 1 centered in channel 3 and hence in slide 2, which the sights are mounted on. Since centering is hardly affected by heat or contamination, the impact pattern will be more uniform. When dirt accumulates in the vicinity of the play, torus 4 will wipe it away like a squeegee when the weapon is discharged. The torus will also, by braking slide 2 as it completes its closing motion, cushion the impact of the barrel and slide against the grip upon termination of the locking motion (FIG. 1).

A barrel-centering protuberance in the form of a torus of a vulcanized elastomer based on a copolymer of vinylidine fluoride and hexafluoropropylene (sold under the brand name VITON e.g.) with a major diameter 14 times its minor diameter (e.g. 14 mm and 1 mm) has been demonstrated particularly practical.

Figure 3:
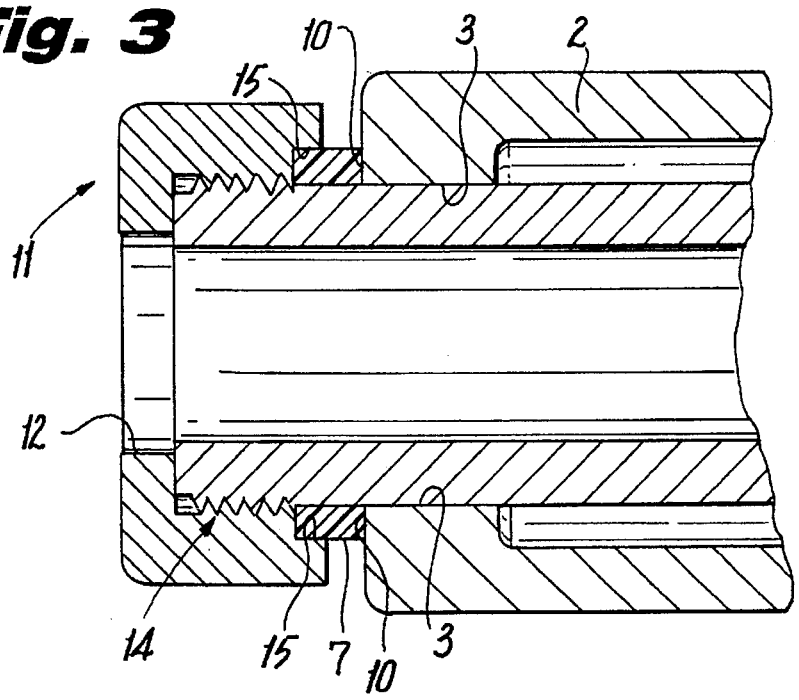
FIG. 3 is a longitudinal section through the vicinity of the muzzle of another embodiment.

The muzzle end of the slide 2 in FIG. 3 incorporates a surface 10 perpendicular to the channel 3 that extends through it. Barrel 1 extends slightly forward beyond channel 3. The muzzle incorporates threads 14 and is protected by a cap 11 that screws over it. There is an opening in the base of cap 11 demarcated by a radially inward flange 12. The opening is wider than channel 3.

Around the inside of the rear edge of cap 11, the edge facing slide 2, is a recess 15. Recess 15 opens toward the rear and is radial with respect to barrel 1. The recess accommodates an elastic and resilient barrel-centering protuberance in the form of ring 7. Ring 7 is a section of straight cylinder. The ring can rest tight and stationary against the outer surface of barrel 1.

The rear surface of ring 7 is radial with respect to the axis of barrel 1 and, in the illustrated state prior to discharge of the weapon, rests tight against surface 10. The axis of barrel 1 is accordingly maintained essentially parallel to that of barrel-alignment channel 3 and hence centered with respect to it. If barrel 1 is intended to be eccentric with respect to channel 3 from the beginning, it will have no effect of accuracy as along as the angle between barrel 1 and the component of the weapon that the sights are mounted on, slide 2 for example, does not vary whenever the weapon is discharged.

Figure 4:
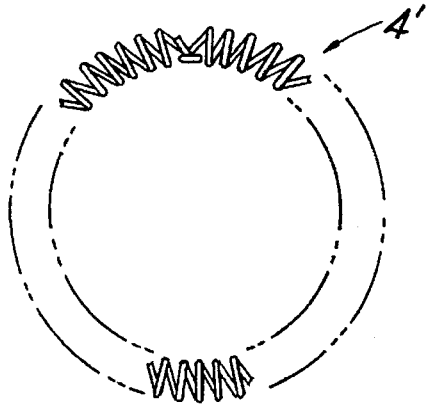
FIG. 4 is a larger-scale top view of one version of a barrel-centering ring.

FIG. 4 illustrates a preferred embodiment of an elastic and resilient barrel-centering protuberance in the form of a helical spring 4' fastened end to end that can be employed instead of or along with the barrel-centering means 4, 5, and 7 illustrated in FIGS. 1 through 3. Spring 4' can be made of spring steel or of another appropriate material, plastic or brass for example.

Figure 5:
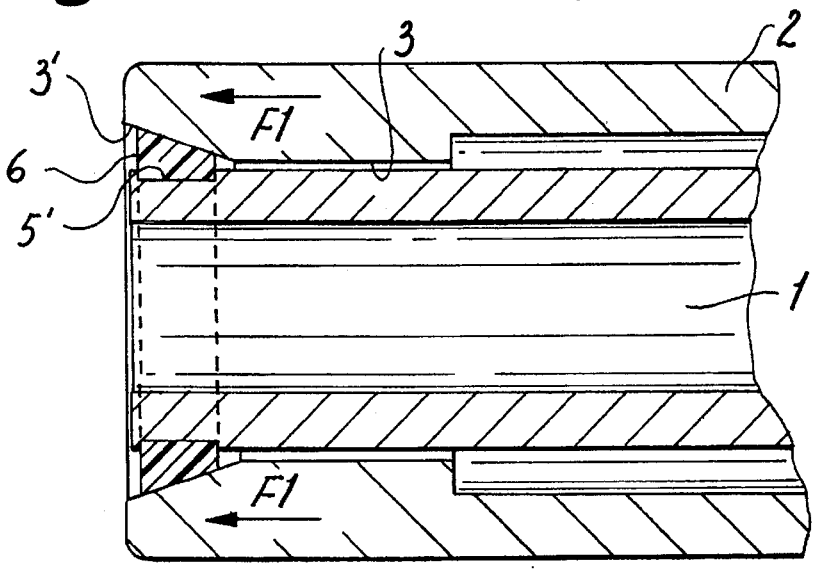
FIG. 5 is a longitudinal section through still another embodiment.

FIG. 5 illustrates a elastic and resilient barrel-centering protuberance in the form of a plastic ring 6 constituting a section of a cone and resting in an annular groove 5' in the muzzle of barrel 1 and against a matching recess 3' around the front of channel 3. With the weapon closed as illustrated, the inner surface of conical recess 3' exerts a force F1 on ring 6. The result is rigid self-centering. Ring 6 could also be screwed onto the muzzle.

What is claimed is:

1. An automatic pistol comprising an essentially cylindrical barrel and a slide, the barrel and the slide move relative to the rest of the pistol and to each other;

a barrel alignment channel located within the slide;

the essentially cylindrical barrel extending through the barrel alignment channel and having a circumferential groove;

an elastic and resilient closed-ring-shaped centering means disposed in the cimumferental groove such as to center the barrel in the slide to avoid jamming by pressing against the slide, wherein the elastic and resilient closed-ring-shaped centering means comprises a helical spring.

2. The automatic pistol of claim 1, wherein the helical spring is made of metal.

3. The automatic pistol of claim 1, wherein the helical spring is made of the same material as the barrel.

4. The automatic pistol of claim 1, wherein the helical spring is made of the same material as the slide.

5. An automatic pistol comprising a barrel and a slide, the barrel and the slide move relative to the rest of the pistol and to each other;

a barrel alignment channel located within the slide;

the slide having a muzzle-end front surface perpendicular to the barrel alignment channel;

the barrel having a muzzle-end extending through the barrel alignment channel;

a ring-shaped cap including a recess being disposed on the muzzle-end of the barrel;

an elastic and resilient centering means held in place by the recess and disposed adjacent to the front surface of the slide, such as to center the barrel in the slide.

* * * * *